US008985329B2

(12) United States Patent
Ullrich

(10) Patent No.: US 8,985,329 B2
(45) Date of Patent: Mar. 24, 2015

(54) ASSEMBLIES, SYSTEMS AND METHODS FOR THE TRANSPORTATION AND DISPLAY OF PLANTS AND FLOWERS

(76) Inventor: Peter Ullrich, Fernandina Beach, FL (US)

( * ) Notice: Subject to any disclaimer, the term of this patent is extended or adjusted under 35 U.S.C. 154(b) by 94 days.

(21) Appl. No.: 13/584,928

(22) Filed: Aug. 14, 2012

(65) Prior Publication Data

US 2014/0048435 A1 Feb. 20, 2014

(51) Int. Cl.

| | |
|---|---|
| ***B65D 85/52*** | (2006.01) |
| ***B65D 21/02*** | (2006.01) |
| ***B65D 25/28*** | (2006.01) |
| ***B65D 5/50*** | (2006.01) |
| ***B65D 5/52*** | (2006.01) |
| ***B65D 85/50*** | (2006.01) |

(52) U.S. Cl.

CPC ..... *B65D 85/52* (2013.01); *B65D 21/0233* (2013.01); *B65D 25/2882* (2013.01); *B65D 5/503* (2013.01); *B65D 5/5213* (2013.01); *B65D 85/505* (2013.01); *B65D 5/5035* (2013.01)

USPC ..... 206/423; 206/736; 206/745; 206/499; 47/84; 47/41.01; 47/41.04

(58) Field of Classification Search

CPC ..... B65D 85/52; B65D 85/50; B65D 5/5035; A01G 5/06

USPC ..... 206/423, 745, 45.25, 768, 499, 813; 47/84, 41.04, 41.01

See application file for complete search history.

(56) References Cited

U.S. PATENT DOCUMENTS

| | | | | | |
|---|---|---|---|---|---|
| 152,758 | A | * | 7/1874 | Mills | 47/86 |
| 1,669,617 | A | * | 5/1928 | Kennedy | 47/84 |
| 1,670,409 | A | | 5/1928 | Einson | |
| 2,300,041 | A | * | 10/1942 | Samuel | 47/84 |
| 2,721,022 | A | | 10/1955 | Billerbeck | |
| 3,284,949 | A | * | 11/1966 | Park | 47/84 |
| 3,379,304 | A | | 4/1968 | Mertz | |
| 3,606,004 | A | * | 9/1971 | Fruehwirth | 206/423 |
| 3,656,611 | A | | 4/1972 | Mertz | |
| 3,660,934 | A | | 5/1972 | Pollack et al. | |
| 3,734,275 | A | | 5/1973 | Greene | |

(Continued)

FOREIGN PATENT DOCUMENTS

| | | |
|---|---|---|
| EP | 1004235 A2 | 5/2000 |
| EP | 1752068 B1 | 1/2001 |

(Continued)

OTHER PUBLICATIONS

Brewer, H.L.; Butler, J.L. (Department of Agriculture, Washington, DC.) "Process and Apparatus for Moving Plant Materials and Containers Useful Therewith," Report PAT-APPL-7-296 109, abstract, Jan. 1989.

(Continued)

*Primary Examiner* — Bryon Gehman
*Assistant Examiner* — Gideon Weinerth

(57) ABSTRACT

A system for efficient transportation and display of plants or flowers has been designed that contains two or more trays and a container. The first tray and alternative tray house the plants or flowers. The second tray, in which the first tray and alternative tray nest, allows for easy movement of the first tray, the alternative tray and the supply of water or nutrients. The container is designed to serve two functions, shipping and displaying.

10 Claims, 5 Drawing Sheets

(56) References Cited

U.S. PATENT DOCUMENTS

| | | | | | |
|---|---|---|---|---|---|
| 3,754,642 | A * | 8/1973 | Stidolph | 206/752 |
| 3,883,990 | A * | 5/1975 | Stidolph | 47/41.01 |
| 3,918,576 | A * | 11/1975 | Taub | 206/764 |
| 3,924,354 | A * | 12/1975 | Gregoire | 47/41.01 |
| 3,973,356 | A * | 8/1976 | Schacht | 47/41.01 |
| 4,075,786 | A | 2/1978 | Van Zyl | |
| 4,113,093 | A * | 9/1978 | Hendrickx | 206/423 |
| 4,118,890 | A | 10/1978 | Shore | |
| 4,148,427 | A * | 4/1979 | Baker | 206/423 |
| 4,170,301 | A | 10/1979 | Jones et al. | |
| 4,184,595 | A * | 1/1980 | Wackerman | 206/423 |
| 4,191,288 | A * | 3/1980 | Hostad | 206/764 |
| 4,236,353 | A | 12/1980 | Sorenson | |
| 4,242,835 | A | 1/1981 | Sorribes | |
| 4,330,059 | A | 5/1982 | Freeman | |
| 4,582,195 | A * | 4/1986 | Carstens | 206/761 |
| 4,662,107 | A | 5/1987 | Van Den Kieboom | |
| 4,742,644 | A | 5/1988 | Groth et al. | |
| 4,936,046 | A | 6/1990 | Miller | |
| 4,941,572 | A * | 7/1990 | Harris | 206/423 |
| 5,022,183 | A * | 6/1991 | Bohlmann | 47/86 |
| 5,029,708 | A | 7/1991 | Alonso et al. | |
| 5,060,799 | A * | 10/1991 | De Pagter | 206/423 |
| 5,141,149 | A | 8/1992 | Fulton | |
| 5,242,052 | A * | 9/1993 | Weder | 206/423 |
| 5,427,240 | A | 6/1995 | Holtkamp | |
| 5,509,254 | A * | 4/1996 | Ullrich | 53/449 |
| 5,819,941 | A | 10/1998 | Vanwingerden | |
| 5,927,009 | A | 7/1999 | Vanwingerden | |
| 6,039,179 | A * | 3/2000 | Weder et al. | 206/423 |
| 6,050,027 | A | 4/2000 | Pavelka et al. | |
| 6,102,204 | A | 8/2000 | Castleberry | |
| 6,394,290 | B1 * | 5/2002 | Walsh et al. | 211/149 |
| 6,446,805 | B1 * | 9/2002 | Mann et al. | 206/423 |
| 6,591,550 | B2 * | 7/2003 | Gilbert | 47/84 |
| 6,604,632 | B2 * | 8/2003 | Weder | 206/423 |
| 6,672,002 | B1 * | 1/2004 | Gumpper | 47/41.01 |
| 6,745,514 | B1 | 6/2004 | Myrland | |
| 6,926,194 | B2 * | 8/2005 | Lane | 229/120 |
| 7,380,662 | B2 * | 6/2008 | Olsthoorn | 206/423 |
| D598,809 | S | 8/2009 | Smith et al. | |
| 7,717,265 | B2 * | 5/2010 | Honkawa et al. | 206/386 |
| 7,788,849 | B1 | 9/2010 | Cleveland | |
| 7,909,168 | B2 * | 3/2011 | Virvo | 206/745 |
| 7,926,655 | B1 | 4/2011 | Branyon et al. | |
| 8,434,619 | B2 * | 5/2013 | Honkawa | 206/423 |
| 8,602,212 | B2 * | 12/2013 | Scanzillo et al. | 206/427 |
| 2002/0092233 | A1 | 7/2002 | Gratz | |
| 2004/0118727 | A1 * | 6/2004 | Pena et al. | 206/423 |
| 2005/0045496 | A1 * | 3/2005 | Jenkins | 206/45.25 |
| 2006/0151356 | A1 * | 7/2006 | Beaty | 206/774 |
| 2008/0053854 | A1 * | 3/2008 | Moerkerken et al. | 206/423 |
| 2008/0083636 | A1 * | 4/2008 | Devine | 206/423 |
| 2009/0114560 | A1 * | 5/2009 | Harshman | 206/423 |
| 2011/0174649 | A1 * | 7/2011 | Garcia | 206/423 |

FOREIGN PATENT DOCUMENTS

| | | | |
|---|---|---|---|
| EP | 1004235 | A3 | 5/2001 |
| EP | 1752068 | A1 | 2/2007 |
| JP | 8040465 | A | 2/1996 |
| JP | 2008254803 | | 10/2008 |
| JP | 201137515 | | 2/2011 |
| WO | 0064760 | | 11/2000 |
| WO | 2007060085 | | 5/2007 |

OTHER PUBLICATIONS

Guyette, James E.; Corrugated Packaging Concept has Plant Industry Blooming; Official Board Markets, v 75, n 15, p. 15-16, 1999; ISSN: 00300284; Publisher: Advanstar Communications, Inc.

Stably, G.L., Kell, J.W., Cunningham, M.S.; "Floral Crop Storage"; Source: Symposium Series—Oregon State University, School of Agriculture, n 1, p. 239-266, 1982; ISBN-10; 0917304268, isbn-13: 9780917304262; Conference: Proceedings of the 3rd National Controlled Atmosphere Research Conference on Controlled Atmospheres for Storage and Transport of Perishable Agricultural Commodities; Sponsor. Oreg State Univ, Dept of Hortic, Corvallis, USA; Publisher: Timber Press.

* cited by examiner

F

ASSEMBLIES, SYSTEMS AND METHODS FOR THE TRANSPORTATION AND DISPLAY OF PLANTS AND FLOWERS

FIELD OF THE INVENTION

The present invention relates to the transportation and display of plants and flowers.

BACKGROUND OF THE INVENTION

Plants and flowers present unique challenges for growers, distributors, and retailers. Because plants and flowers are alive, they can be fragile, and special attention must be paid to how they are transported. Accordingly, there is a need for safe and efficient means by which to transport them.

At the same time, retailers must not only receive sellable plants and flowers, but retailers must also display them in a manner that maximizes the likelihood that a consumer would want to purchase an item. In order to increase the appeal of the products, retailers could employ persons whose responsibilities would include overseeing the arrangement of displays of plants and flowers. However, this can readily be seen as inefficient. Unpacking plants and flowers from shipping containers or pallets, and then arranging them in a display can be time consuming, and to be effective can require a skill set that takes time to develop.

Thus, there remains a need to develop a means by which to ship plants and flowers efficiently and to enable a retailer to display them in a desirable manner without an unacceptable amount of effort.

SUMMARY OF THE INVENTION

The present invention is directed toward assemblies, systems and methods for transporting and displaying plants and flowers. Through the use of various embodiments of the present invention, one may more easily and more efficiently transport and display plants and flowers than one can do with commonly used systems.

According to a first embodiment, the present invention provides a plant or flower shipping container and display system comprising: (a) first tray, wherein the first tray comprises a compartment that forms a cavity; (b) a second tray, wherein the second tray comprises at least one handle and the first tray is configured to nest in the second tray; and (c) a container, wherein the container is configured to permit the second tray to nest in the container and has a top side and bottom side, wherein the top side may be opened to a size that permits removal of the first tray and the second tray, and wherein the at least one handle is configured to permit a user to move the second tray and the first tray when the first tray is nested in the second tray.

In an alternative embodiment, the present invention provides a plant or flower shipping container and display system comprising: (a) first tray, wherein the first tray comprises a compartment that forms a cavity; (b) an alternative tray having a different design from the first tray, wherein said alternative tray comprise an alternative compartment that forms an alternative cavity; (c) a second tray, wherein the second tray comprises at least one handle and the first tray is configured to nest in the second tray; and (d) a container, wherein the container is configured to permit the second tray to nest in the container and has a top side and bottom side, wherein the top side may be opened to a size that permits removal of the first tray and the second tray, and wherein the at least one handle is configured to permit a user to move the second tray and the first tray when the first tray is nested in the second tray.

According to a second embodiment, the present invention provides a plant or flower shipping container and display system comprising: (a) a first tray, wherein the first tray comprises a plurality of compartments that are arranged in an array and each compartment has a cavity with at least one hole at a base; (b) a second tray, wherein the second tray comprises a first handle and a second handle, wherein the first handle is attached to a first side of the second tray and the second handle is attached to a second side of the second tray, and further wherein the first tray is nested in the second tray and the second tray forms a basin that holds water; and (c) a container, wherein the container is configured to permit the second tray to nest in the container and has a top side and a bottom side, wherein the top side may be opened to a size that permits removal of the first tray and the second tray, and wherein the first handle and the second handle are configured to permit a user to move the second tray and the first tray when the first tray is nested in the second tray.

According to a third embodiment, the present invention provides a method for preparing flowers or plants for transportation, the method comprising: (a) inserting a first tray into a second tray, wherein the first tray comprises a plurality of compartments, wherein each compartment forms a cavity with a base, and wherein the second tray forms a basin and the first tray is configured to nest in the second tray, and the second tray comprises at least one handle, wherein the at least one handle is configured to permit a user to carry the first tray while it is nested in the second tray; (b) inserting the second tray into a container through a top opening of the container, wherein an exterior side of the container has a notation that indicates a preferred orientation for the container during transportation; and (c) optionally, inserting water into the basin.

According to a fourth embodiment, the present invention provides a method for displaying a plant or flower comprising: (a) the method of the embodiment described in the previous paragraph; (b) removing the second tray from the container through the top opening; (c) changing the orientation of the container to form a re-oriented container; and (d) placing the second tray on an exterior surface of the re-oriented container.

Through the use of the various embodiments of the present invention, a person of ordinary skill in the art may see one or both of the following benefits: increased efficiency of transportation of plants or flowers; and decreased burden in displaying plants or flowers.

DETAILED DESCRIPTION OF THE INVENTION

Figure 1:
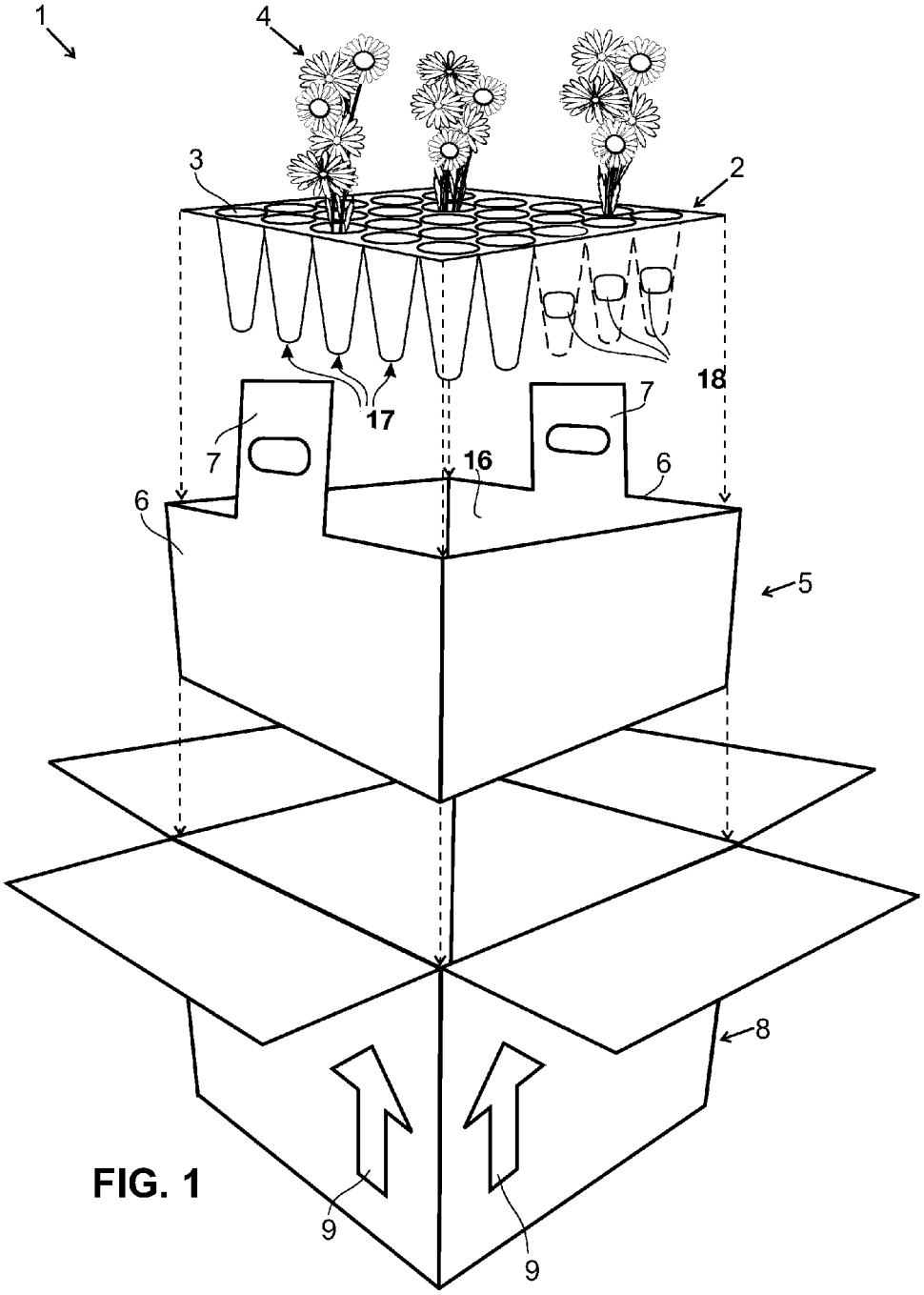
FIG. 1 is a representation of a set of components of the present invention.

For the purposes of this specification and appended claims, unless otherwise indicated, all numbers expressing quantities, percentages or proportions of materials, or other numerical values used are to be understood as being modified in all instances by the term "about." Accordingly, unless indicated to the contrary, the numerical parameters set forth in the following specification and attached claims are approximations that may vary depending upon the desired properties sought to be obtained by the present application. At the very least, and not as an attempt to limit the application of the doctrine of equivalents to the scope of the claims, each numerical parameter should be construed at least in light of the number of reported significant digits and by applying ordinary rounding techniques.

Additionally, any numerical value inherently contains certain errors necessarily resulting from the standard deviation found in the respective testing measurements. Moreover, all ranges disclosed herein are to be understood to encompass any and all subranges subsumed therein. For example, a range of "1 to 10" includes any and all subranges between (and including) the minimum value of 1 and the maximum value of 10. Thus, it would include any and all subranges having a minimum value of equal to or greater than 1 and a maximum value of equal to or less than 10, e.g., 5.5 to 10.

It is also noted that as used in this specification and the appended claims, the singular forms "a," "an," and "the," include plural referents unless expressly and unequivocally limited to one referent. Furthermore, it is noted that the terms "and" and "or" should, unless otherwise stated or implicit from context, be construed to be inclusive. Thus, a system that may be used for plants and flowers is within the scope of the present invention regardless of whether it contains neither plants nor flowers, only flowers, only plants or both plants and flowers.

Reference will now be made in detail to certain embodiments of the present invention. While the application will be described in conjunction with the illustrated embodiments, it will be understood that the embodiments are not intended to limit the invention. On the contrary, the application is intended to cover all alternatives, modifications, and equivalents that may be included within the application as defined by the appended claims.

The various embodiments of assemblies, systems and methods of the present invention provide shipping containers and display elements that impart efficiency to businesses involved in one or more of growing, transporting and selling plants or flowers. In one embodiment, the present invention provides a system that comprises a first tray, a second tray and a container.

The term "tray" refers to a structure that may for example allow objects to sit on a horizontal or substantially horizontal surface and/or in cavities or on protrusions extending vertically from a horizontal surface. Furthermore, a tray may have only one horizontal plane from which compartments may emerge or from which side walls may emerge or have a plurality of horizontal tiers or levels, e.g., at least 2, at least 3, 2-5 or 2-4 or 2 or 3 or 4 or 5, and still be considered a tray. When there is a plurality of tiers, the tiers may be oriented concentrically with the highest tier in the middle, or in rows of parallel steps with the highest tier forming a back line and the lowest tier forming a front line. As noted above, a tray may or may not have side walls, but when side walls are present, typically both the length and the width of the largest horizontal dimension or surface of the tray are greater than the height dimension of any side walls. Similarly, if compartments with cavities are present, typically both the length and the width of the largest horizontal dimension or surface of the tray are greater than the depth of any compartments.

The first tray is designed to hold plants or flowers, and the present invention is not limited to systems that transport any particular types of plants or flowers. As a person of ordinary skill in the art recognizes, when transporting plants or flowers it may be advantageous to transport them in an environment that will prolong their lives or at least not have an unacceptably high negative impact on the viability of the plants or flowers. For example, they may be transported in soil, with a supply of water and/or with a supply of nutrients.

In order to increase efficiency and thereby to reduce the cost of transportation, plants and flowers may be transported from a first location to a second location in trays that contain a plurality of compartments. Each compartment may be configured to hold a single plant, a plurality of plants, a single flower or a plurality of flowers. Additionally, an organism is considered to be a plant regardless of whether it has sprouted, e.g., a seed that has the potential to sprout is within the scope of the term "plant," as are tubers, bulbs, saplings, flowering plants and non-flowering plants. By shipping a tray with multiple compartments in one container, a shipper can reduce the number of containers that he or she uses. In some embodiments, exactly one first tray and one second tray are shipped in a container.

The compartments may be arranged randomly, in arrays or in patterns other than arrays. In some embodiments, there may be 24-144, 36-96, 24, 25, 36, 48, 49, 64 or 96, etc. compartments. The compartments of the first tray may in some embodiments themselves be configured so that they can be separated. For example, the tray may contain perforations between compartments. Alternatively or additionally, one or more or all of the compartments themselves may contain plants and soil, pots containing plants and soil, or flowers associated as bouquets that are located within the compartments and that can be removed from the compartments. Regardless of whether a compartment has a pot within it, the compartment will form a cavity. A cavity is a three-dimensional space in which a flower, a bouquet, a plant (with or without soil) or a pot containing a flower or a plant (with or without soil) may be situated.

Each compartment may have a base, which refers to a location at or near the bottommost depth of the cavity, and in some embodiments, each compartment is the same size. A base may be a regular or irregular surface, and it may be flat, rounded or angled. In some embodiments, the base has one or more holes. These holes can be used to allow for the drainage of materials such as water out of the compartment and/or the transportation of materials such as water into the compartment.

A wicking device, such as a wick made of a hydrophilic material, e.g., cotton, synthetic plastic, wool or non-woven polyester or a combination thereof, may enter the compartment through a hole. As persons of ordinary skill in the art and aware, a wicking device permits the movement of liquids in spite of the force of gravity. If substances are dissolved as part of a liquid solution, they may be transported by the wick. If a pot is inserted into the compartment it too may have one or more holes that permit the transportation of water and or nutrients. This may be done with or without the assistance of a wicking device. In some embodiments, one or more holes in a pot are aligned with one or more holes of a compartment.

The second tray may form a basin. Thus, it may be configured to have a bottom and side walls that extend from the bottom. The basin may also be configured to hold a liquid, for example, water or other liquid that optionally contains nutrients.

The second tray is designed to be a shape and a size that permits the first tray to nest in it. For example, the first tray and the second tray may both be the same shape in two dimensions, such as a circle, an ellipse, a square, a rectangle, etc. In some embodiments, the bottom of the basin formed by the second tray may be flat. Additionally, the horizontal dimensions of the second tray may be slightly larger than those dimensions of the first tray, thereby enabling the first tray to easily be inserted into the second tray, and to sit within the second tray, but not to move an undesired amount when located therein. In some embodiments, the second tray may be at least 0.1%, at least 0.5%, at least 1.0%, at least 2.0%, or at least 5.0% wider and/or longer than the first tray and up to 20%, up to 10%, up to 5%, up to 3%, up to 2% or up to 1% wider and/or longer than the first tray.

The second tray may be designed such that when the first tray nests therein, the sides of the second tray are taller than the depth of the compartments of the first tray. Thus, in these embodiments, the first tray may sit on the bottom of the second tray, but not be visible from a side view. In an alternative design the compartments of the first tray may have a depth that is greater than the size of the sides of the second tray. In these embodiments, upper portions of the first tray will be visible from a side view of the second tray when the first tray sits on the bottom of the basin and is nested in the second tray. In still another embodiment, the first tray has two or more clips (e.g., four or sixteen) that engage the side walls of the second tray. These clips may be used to ensure greater stability during transport and optionally if the side walls are higher than the depth of the compartments to permit the first tray's compartments to be suspended above the base of the second tray. If these clips are present, they may be evenly distributed around the perimeter of the first tray.

The second tray may also have at least one handle e.g., two handles. Thus, there may be a first handle that is attached to a first side of the second tray and a second handle is attached to a second side of the second tray. The two handles may extend vertically or substantially vertically from the second tray and may each have a hand grip or spaces for inserting one's fingers to render carrying easier. A handle is considered to emerge from a side if the handle is connected to a vertical surface of that side or from the top of that side. Alternatively, there may be one handle that e.g., forms an arch over the basin, and the two trays may be lifted by the single handle. This single handle may be attached to two or more sides of the second tray.

In some embodiments the handles may be made of a rigid material and capable of being oriented in only one position (the position that allows the first tray and the second tray to be moved when the first tray is nested in the second tray). In other embodiments, the handles may be made of a semi-rigid material and/or be designed to exist in two or more configurations relative to the second tray. For example, the handles may be configured to exist in a first orientation relative to the second tray that is vertical or substantially vertical relative to the base of the second tray and that facilitates easy transportation of the second tray. The handles may also be capable of being oriented in a second orientation that may, for example, be between 15° and 180° or between 90° and 135° away from the first orientation. In order to facilitate movement between the two (or more) orientations, each handle may be made of a sufficiently flexible material to be moved or a hinge may be used. If a hinge is used, the hinge (with the appropriate hardware) may be designed to allow movement of each handle between two more or more discrete positions. A first position may for example be vertical and a second position may for example be 90 degrees relative to the vertical, i.e., horizontal. A person of ordinary skill in the art will appreciate that handles may also have decorative features including configurations that are designed in part or in whole for aesthetic reasons. This may include being not completely straight. When the handles are not straight the angle should be construed as being measured in the proximity of attachment of either the handle and the hinge or the handle and the side wall of the second tray.

In some embodiments, the second tray and the handles comprise, consist essentially of, or consist of one or more of cardboard, plastic, or metal. In order to permit the second tray to hold a liquid, it may be lined with a suitable liner that comprises, consists essentially of or consists of plastic. In other embodiments, the second tray itself comprises, consists essentially of or consists of plastic, and there may not be any separate liner.

In an alternative embodiment, the present invention also includes one or more alternative trays nesting within the second tray that are of a different design from the first tray. More specifically, the alternative tray comprises one or more alternative compartments that are of the same or different design from the first tray. The alternative compartment may comprise an alternative cavity which may be of the same or different design from the cavity present in the first tray. The alternative tray may be designed to hold the same or different floral system as the first tray. For example, the first tray may be designed to hold flower bouquets while the alternative tray may be designed to hold flower arrangements, and vice versa. The alternative tray may be taller or shorter than the first tray, or may be of the same height. The alternative tray may be constructed of the same or of different material from the first tray. For example, the first tray may be constructed of plastic while the alternative tray is constructed of cardboard, and vice versa.

Preferably, the first tray and alternative tray are sized so that they will both fit securely into the second tray. Alternatively, if the first tray and the alternative tray do not fit securely into the second tray, well known filling materials such as additional cardboards or packing materials can be used to fill in the space to create a good fit. The first tray and alternative tray may be the same size or of different size. For example, the first tray may be bigger than the alternative tray, and vice versa. Additionally, there may be multiple first trays or alternative trays present.

In addition, there may be one or more dividers or physical barriers present to separate the first tray from the alternative tray. The divider may be constructed of any suitable material such as paper, cardboard, plastic, metal, and or combinations thereof. The divider may be of any height shorter than the container and may be of any shape or design necessary to separate the first tray from the alternative tray.

The container may be a box that can be opened and closed. When closed it may for example be sealable with tape or other adhesive.

Preferably, the container is designed to be able to support the second tray and the first tray when the first tray is nested in the second tray and the second tray rests on the bottom inside of the container and when it rests on the exterior of the bottom or another side of the container. In some embodiments, the bottom interior of the container may be flat, and the outside of the bottom (i.e., the exterior) may also be flat.

Preferably, the container is configured to be a size and shape that permit the second tray to sit securely within it during transport, but enable easy insertion and removal of the second tray from the container. Thus, it may have a larger width and length than the second tray. Accordingly, in some embodiments the base of the container may be at least 0.1%, at least 0.5%, at least 1.0%, at least 2.0%, or at least 5.0% wider and/or longer than the second tray and up to 20%, up to 10%, up to 5%, up to 3%, up to 2% or up to 1% longer and/or wider than the base of the second tray. Similarly, it may be at least 0.1%, at least 0.5%, at least 1.0%, at least 2.0%, or at least 5.0%, and up to 20%, up to 10%, up to 5%, up to 3%, up to 2% or up to 1% taller than the height of the second tray inclusive of the tallest height of the handle or handles. If the handles are rigid or semi-rigid, they may add further stability to the container during shipping, and/or prevent undesirable movement of the second tray during transportation.

The container may also contain an indicator or notation on an exterior side that indicates a correct orientation for the container when the first tray and the second tray are contained within the container and during transportation. By way of a non-limiting example the indicator may be an arrow that points to an opening i.e., the top side. The indicator may be on one, two, three or four sides of the container. When the container is inverted, the indicator may point in the opposite direction, i.e., down. Alternatively or additionally, there may be writing such as "This Side Up During Transportation" in one or more languages.

The various components of the system may be made out of materials that enable them to provide their intended function. For example, the first tray may consist of, consist essentially of or comprise plastic, metal or cardboard or combinations thereof. Similarly and as noted above, the second tray inclusive of the handle or handles may consist of, consist essentially of or comprise plastic, metal or cardboard or combinations thereof. Additionally, the container may comprise, consist essentially of or consist of plastic, cardboard or metal and combinations thereof.

By way of a non-limiting example, the first tray may be one 1 foot to 3 feet long and wide and have a depth of 3 inches to 18 inches. In these cases, the second tray may for example be 13 inches to 38 inches long and wide and have side walls along each side that are 1 to 24 inches high. Additionally, the handle or handles may for example extend an additional 32-48 inches above the top of the side walls of the second tray. Further, the container may for example, be a cube that is approximately 34 inches to 74 inches on a side.

According to a second embodiment, the present invention provides a plant or flower shipping container and display system comprising a first tray, a second tray and container. The first tray comprises a plurality of compartments that are arranged in an array. Each compartment has a cavity with at least one hole at a base. The second tray comprises a first handle and a second handle. The first handle is attached to a first side of the second tray and the second handle is attached to a second side of the second tray. The first side and the second side may be opposite sides of the second tray, or in the case of circular tray, 180° apart.

The first tray is nested in the second tray and the second tray forms a basin that holds water. The first handle and the second handle may be configured to permit a user to move the second tray and the first tray when the first tray is nested in the second tray. The container is configured to permit the second tray to nest in it and has a top side and bottom side. The top side may be able to be opened to a size that permits removal of the first tray and the second tray.

According to a third embodiment, the present invention provides a method for preparing flowers or plants for transportation. In the method, one inserts a first tray into a second tray. The first tray comprises a plurality of compartments. Each compartment forms a cavity with a base. Alternatively, the method also includes inserting an alternative tray having a different design from the first tray into the second tray. The alternative tray comprises a plurality of alternative compartments. In each of one or more, if not all of the compartments or alternative compartments may be a plant, pot, bouquet or individual flower. The second tray forms a basin and is configured to permit the first tray to nest within it. The second tray also comprises at least one handle, wherein the at least one handle is configured to permit a user to carry the first tray (and alternative tray if present) while it is nested in the second tray. Next, one may insert the second tray into a container through a top opening. An exterior side of the container may contain a notation that indicates a preferred orientation for the container during transportation. Optionally, before or after putting the second tray into the box, one may insert water into the basin.

According to a fourth embodiment, the present invention provides a method for displaying a plant or a flower. The method begins with transporting flowers or plants as described herein. Next one removes the second tray from the container through the top opening. After removal of the trays, one can change the orientation of the container to form a re-oriented container. Next one places the second tray on the re-oriented container. Thus, it rests on an exterior surface of the container. A "re-oriented" container is one that is oriented in a direction that is different from the intended orientation during transportation. This may refer to an orientation that is the opposite of the intended shipping orientation, e.g., upside down or on its side.

The container and optionally the second tray and/or first tray and/or alternative tray may be decorated prior to shipping. Alternatively or additionally, one or more or all of the first tray, the second tray or third tray, or alternative tray may contain a notation of the flowers or plants that are being transported. Thus, when the plants or flowers are on display on top of the re-oriented container, the decorations and identification of the organism if present will be visible.

In order to further illustrate the present invention, reference will now be made to the accompanying figures. These figures are intended for illustrative purposes only, and should not be interpreted as binding the scope of the claims in any way.

FIG. 1 is a representation of the components of a system 1 of the present invention. A first tray 2 is shown with an array of compartments 3, and flowers 4 in some of the compartments. The first tray is of a size that permits it to nest in second tray 5, which has side walls 6 that form a basin. In an exemplary embodiment, the second tray may comprise a liner 16 such that the liner lines the basin formed by the interior walls. Also present on the second tray are two handles 7 that are located on opposite side of the tray. The second tray is designed to be of a size and shape that permits it to nest with the container 8, which has two identifiers 9 that indicate the proper orientation during transport. In various embodiments, the base of each compartment may contain one or more holes 17. In the exemplary embodiment shown in FIG. 1, the holes of the compartment appear at the bottom of the compartment and are not visible in the FIGURE. Additionally, a wicking device 18 may also be contained within the compartment.

Figure 2:
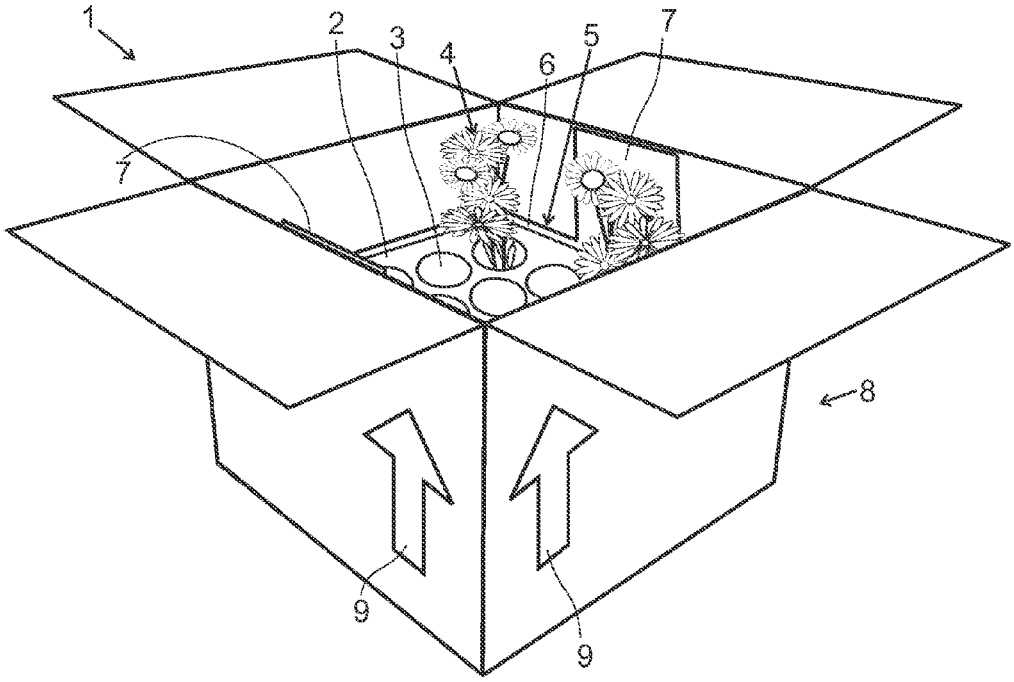
FIG. 2 is a representation of a first tray nested in a second tray, which is nested in a container.

FIG. 2 shows the system 1 of FIG. 1 in which first tray 2 nested in the second tray 5, which is nested in the container 8. For reference, the compartments 3 and flowers 4 are also shown, as are the handles 7 and side walls 6 of the second tray extending slightly higher that than the top of the first tray when the first tray is nested in the second tray. The two sides of the container 8 that are shown each have an arrow 9 that indicates the proper orientation of the container during transport.

Figure 3:
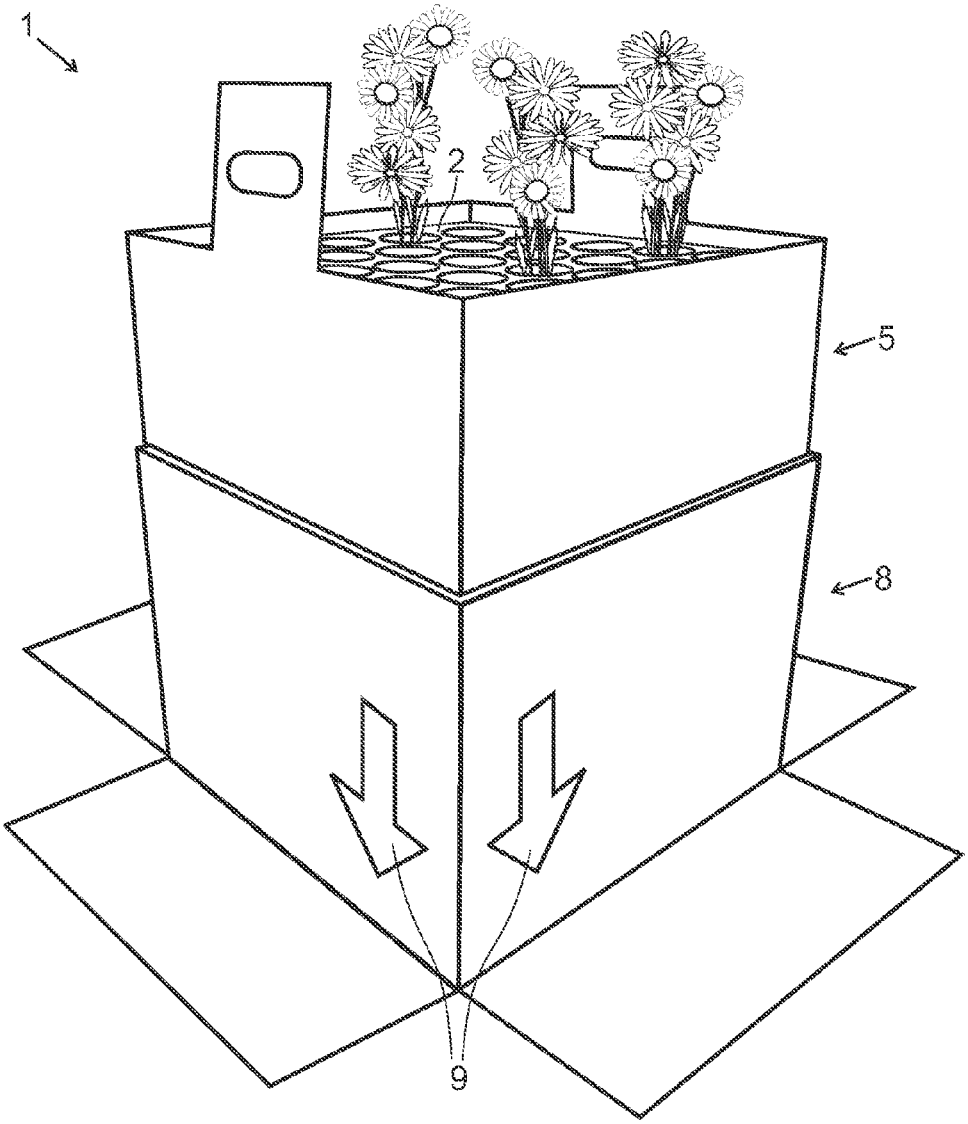
FIG. 3 is a representation of a display of the present invention in which the handles are upright.

FIG. 3 illustrates a system 1 with the first tray 2 within the second tray 5 as displayed on the container 8, which is upside down relative to the intended orientation during transport. The identifiers 9 are now pointing down.

Figure 4:
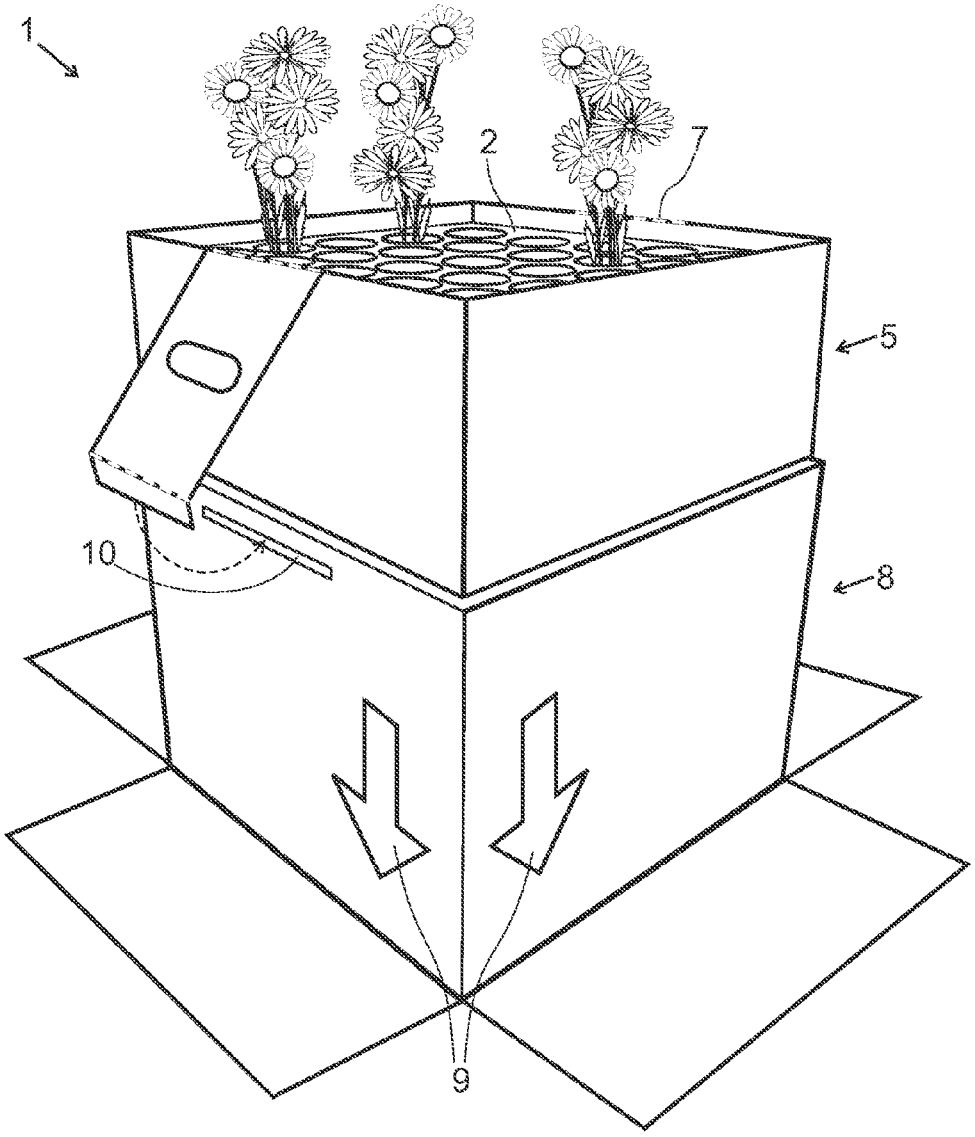
FIG. 4 is a representation of a display of the present invention in which the handles have been pulled down.

FIG. 4 illustrates another display system 1 with a first tray 2 within the second tray 5 on the container 8, which has identifiers 9 pointing down. However, as distinguished from the FIG. 3, the handles 7 in FIG. 4 have been pulled down.

FIG. 4 also shows an additional and optional feature of an opening 10 in the side of the box 8. The opening is configured to receive a portion of the handle 7. The opening may for example be a slit or a rectangle or other shape that permits entry of the end of the handle. In some embodiments, there is at least one opening for each handle. Thus, where there are two handles, there may be two openings, one on each side of a pair of opposite sides of the box 8. Each opening is preferably located a distance from the base of the box (which is the side on which tray 5 sits) that is less than the difference between the length of the handle and the side of the tray, i.e., the handle is long enough to reach to the opening and for a portion of it to be inserted into the opening. Further, in some embodiments, each handle is sufficiently long that 1 to 10 cm or 1 to 5 cm or 2 to 5 cm of the handle can be inserted through each slit 10. The handles are preferably sufficiently flexible to be positioned such that their ends can be manipulated to enter the openings and sufficiently long such that after entry, they will not leave the openings unless a force is exerted. Furthermore, they may be semi-rigid at their ends (and optionally elsewhere) and there may be a joint and/or visual cue (e.g., a line) that demarks the portions to be inserted into these openings. Still further, in some embodiments, the openings are larger than the cross-section of the handles, while in other embodiments, they are the same size or slightly smaller than the cross-section of the handles, such that a force is needed to insert the handles and friction prevents their removal absent an external force to remove them from the openings.

Still further, in some embodiments during transport the openings are covered or filled with a perforated material that can be removed during use of the system as a display.

Figure 5:
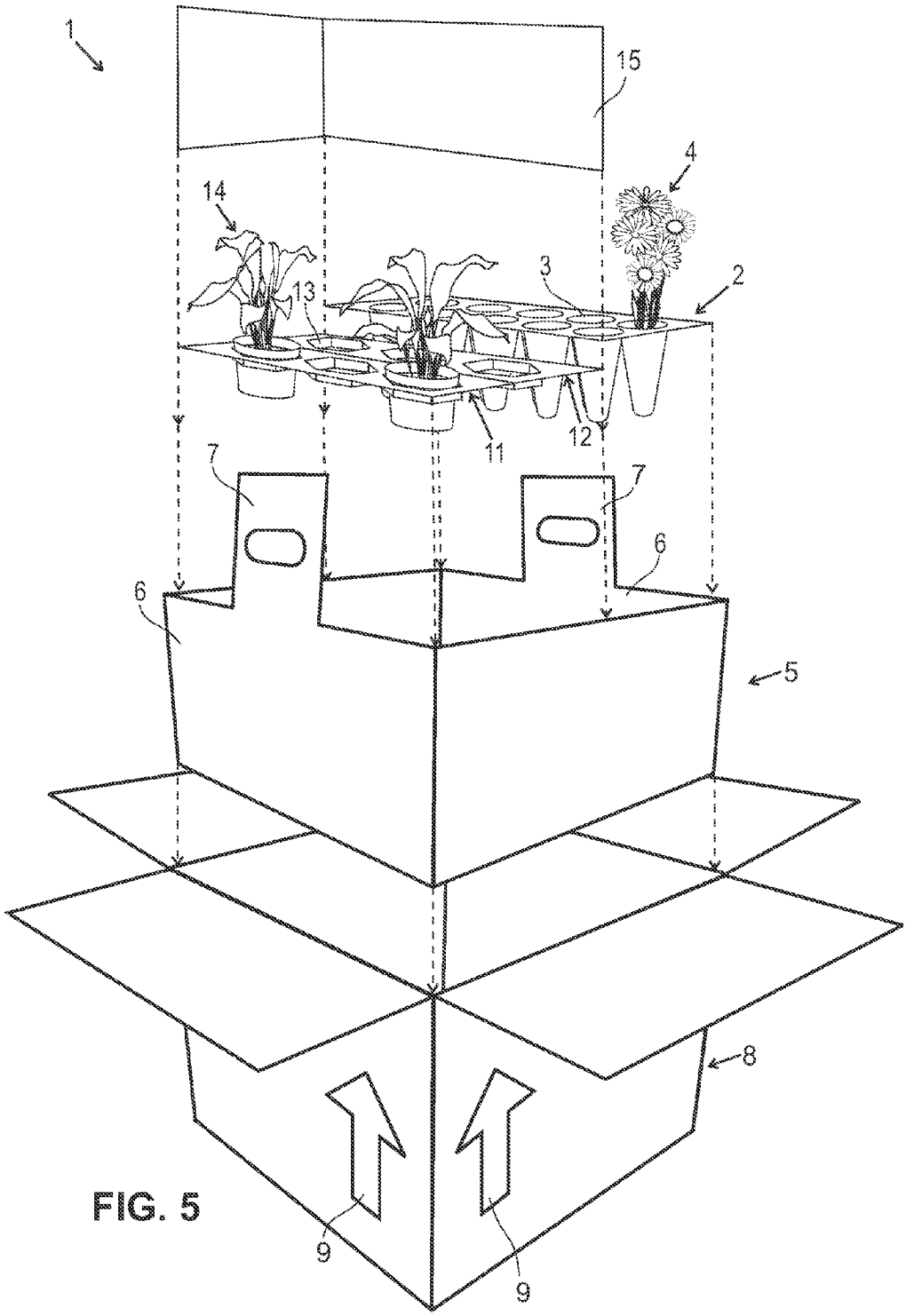
FIG. 5 is a representation of a set of components of an embodiment of the present invention.

FIG. 5 is a representation of the components of a system 1 of an alternative embodiment of the present invention. A first tray 2 is shown with an array of compartments 3, and flowers 4 in some of the compartments. Alternative trays 11 and 12 are shown with an array of alternative compartments 13 and alternative flower arrangements 14 in some of the compartments. The first tray and alternative trays are of a size that permits them to nest in second tray 5, which has side walls 6 that form a basin. Also present on the second tray are two handles 7 that are located on opposite side of the tray. The second tray is designed to be of a size and shape that permits it to nest with the container 8, which has two identifiers 9 that indicate the proper orientation during transport. A divider 15 is also present to separate the first tray 2 from the alternative trays 11 and 12.

Unless otherwise specified, any of the features of the various embodiments described herein can be used in conjunction with features described in connection with any other embodiment disclosed. Accordingly, features described in connection with the various or specific embodiments are not to be construed as not suitable in connection with other embodiments disclosed herein unless such exclusivity is explicitly stated or implicit from the context.

I claim:

1. A plant or flower shipping container and display system comprising:

a) a first tray, wherein said first tray comprises a compartment that forms a cavity, wherein the compartment of said first tray has a base and the base has a hole;

b) an alternative tray having a different design from the first tray, wherein said alternative tray comprises an alternative compartment that forms an alternative cavity;

c) a second tray, wherein the second tray comprises at least a first handle and a second handle, wherein the first handle is attached to a first side of the second tray and the second handle is attached to a second side of the second tray, and the second tray is configured to permit the first tray and the alternative tray to nest in the second tray; and d) a container, comprising an opening in each of two sides of the container, wherein one opening is configured to receive an end of the first handle and a second opening is configured to receive an end of the second handle, wherein the container is configured to permit the second tray to nest in the container and has a top side and a bottom side, wherein the top side may be opened to a size that permits removal of the first tray, the alternative tray and the second tray, further wherein the bottom exterior of the container is flat and the container is able to support the second tray and the first tray and the alternative tray when the first tray and the alternative tray are nested in the second tray and the second tray rests on the bottom exterior of the container, and wherein the at least one handle is configured to permit a user to move the second tray, the first tray and the alternative tray when the first tray and the alternative tray is nested in the second tray.

2. The system of claim 1, wherein the first tray comprises a plurality of compartments that each forms a cavity and the alternative tray comprises a plurality of alternative compartments that each forms an alternative cavity.

3. The system of claim 2, wherein the plurality of compartments form a first array and the plurality of alternative compartments form a second array.

4. The system of claim 1, wherein the second tray forms a basin that holds a liquid.

5. The system of claim 4, wherein the second tray comprises cardboard and the system further comprises a liner, wherein the liner lines the basin of the second tray 5.

6. The system of claim 1, wherein the container contains an indicator on an exterior side that indicates a correct orientation for the container when the first tray, the alternative tray and the second tray are within the container.

7. The system of claim 1 further comprising a divider to separate the first tray and the alternative tray.

8. The system of claim 1 further comprising a wicking device.

9. The system of claim 1 wherein the first tray and alternative tray are constructed of different materials.

10. The system of claim 1 comprising a plurality of said alternative trays nesting with said first tray in said second tray.

* * * * *